US005153647A

United States Patent [19]

Barker et al.

[11] Patent Number: 5,153,647

[45] Date of Patent: Oct. 6, 1992

[54] DEVELOPMENT SYSTEM HAVING TENSIONED ELECTRODE WIRES

[75] Inventors: Laurence S. Barker, Fairport; Thomas J. Behe, Webster; Daniel M. Bray, Rochester; James R. Davidson, Rochester; Jeffrey J. Folkins, Rochester; Gerald M. Kryk, Webster; Joseph G. Schram, Liverpool, all of N.Y.

[73] Assignee: Xerox Corporation, Stamford, Conn.

[21] Appl. No.: 722,427

[22] Filed: Jun. 27, 1991

[51] Int. Cl.[5] ..... G03G 15/06

[52] U.S. Cl. ..... 355/245; 118/661; 355/259; 355/261

[58] Field of Search ..... 355/251, 245, 246, 249, 355/259, 261; 118/659, 651, 653, 654, 656, 661

[56] References Cited

U.S. PATENT DOCUMENTS

| | | | |
|---|---|---|---|
| 3,653,758 | 4/1972 | Trimmer et al. | 118/637 |
| 3,741,117 | 6/1973 | Bienert et al. | 101/426 |
| 3,766,646 | 10/1973 | Froebe et al. | 29/826 |
| 4,868,600 | 9/1989 | Hays et al. | 355/259 |
| 4,876,575 | 10/1989 | Hays | 355/259 |
| 4,990,958 | 2/1991 | Brewington et al. | 355/245 |

*Primary Examiner*—A. T. Grimley
*Assistant Examiner*—Thu A. Dang
*Attorney, Agent, or Firm*—H. Fleischer; J. E. Beck; R. Zibelli

[57] ABSTRACT

An apparatus which develops an electrostatic latent image recorded on a photoconductive member with toner particles. A donor member is spaced from the photoconductive member and transports toner particles to a development zone adjacent the photoconductive member. Electrode wires are positioned in the development zone between the photoconductive member and the donor member. The electrode wires are electrically biased to detach toner particles from the donor member to form a cloud of toner particles in the development zone. Toner particles detached from the toner particle cloud develop the latent image. The electrode wires are adjustably supported in tension adjacent the donor member.

25 Claims, 3 Drawing Sheets

DEVELOPMENT SYSTEM HAVING TENSIONED ELECTRODE WIRES

This invention relates generally to an electrophotographic printing machine, and more particularly concerns a single component development system.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. One type of single component development is scavengeless development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In scavengeless development systems, the location and mounting of the wires is critical. The wires must be accurately adjusted relative to the donor roll while being free to be properly positioned against the donor roll with the appropriate tension. Various techniques have been devised for tensioning a photoconductive member against a roller during image development. U.S. Pat. No. 4,264,182 discloses a tension spring that regulates the tension between a photoconductive supply roller and a magnetic brush developer roller during image development. U.S. Pat. No. 4,397,264 and U.S. Pat. No. 4,641,946 describe a coil spring that regulates the tension of a photoconductive belt wrapped about a portion of a developer roll. U.S. Pat. No. 4,614,419 discloses an inductive charging system that has a spring which presses an electrode against a belt contacting developer material on a developer roller. U.S. Pat. No. 4,713,673 describes a spring that exerts a force against a rod to urge one of four developing units within an integrated revolving unit against a photoconductive drum. U.S. Pat. No. 4,792,825 discloses a rotary developing device having a lever pivotally connected to an inner support arm that delivers a force against a developer unit through the action of a tension spring. The following disclosures may be relevant to various aspects of the present invention:

U.S. Pat. No. 4,868,600
Patentee: Hays et al.
Issued: Sep. 19, 1989

U.S. Pat. No. 4,876,575
Patentee: Hays
Issued: Oct. 24, 1989

U.S. Pat. No. 4,990,958
Patentee: Brewington et al.
Issued: Feb. 5, 1991

Co-pending U.S. patent application Ser. No. 07/428,726
Applicant: Brewington et al
Filed: Oct. 30, 1989

Co-pending U.S. patent application Ser. No. 07/537,660 Applicant: Brewington et al Filed: Jun. 14, 1990

The relevant portions of the foregoing disclosures may be briefly summarized as follows:

U.S. Pat. No. 4,868,600 describes a scavengeless development apparatus in which toner detachment from a donor roll and generation of a controlled powder cloud is obtained by AC electrically biased electrode wires.

U.S. Pat. No. 4,876,575 discloses a donor roll having a rotating metering and charging rod forming a toner metering and charging zone through which toner is moved to simultaneously charge and meter the toner particles. The rod is supported by a distributed bearing attached to a compliant blade. A toner cleaning blade held against the rod serves as a toner seal. The rod is electrically biased.

U.S. Pat. No. 4,990,958 describes a scavengeless development apparatus in which toner detachment from a donor roll and generation of a controlled powder cloud is obtained by AC electrically biased electrode wires. A reload member supported in rubbing contact with an electrically biased toner mover effects reloading of the donor roll with toner. The toner mover serves to transport toner from a remote supply of toner to an area in the opposite the donor roll.

Co-pending U.S. patent application Ser. No. 07/428,726 and co-pending U.S. patent application Ser. No. 07/537,660 describe a development system having a hollow tube having holes therein which fluidizes and moves toner particles from one end of a developer housing to the other end thereof. The tube is electrically biased so that toner particles are attracted from the tube to a donor roller. A charging blade is maintained in contact with the donor roll to charge the toner layer on the donor roller.

In accordance with one aspect of the present invention, there is provided an apparatus for developing a latent image recorded on a surface with marking particles. The apparatus includes a donor member spaced from the surface and adapted to transport marking particles to a development zone adjacent the surface. An electrode member is positioned in the development zone between the surface and the donor member. The electrode member is electrically biased to detach marking particles from the donor member so as to form a cloud of marking particles in the development zone. Detached marking particles from the cloud of marking particles develop the latent image. Means are provided for supporting and tensioning the electrode member adjacent the donor member.

Pursuant to another aspect of the present invention, there is provided an electrophotographic printing machine of the type in which an electrostatic latent image recorded on a photoconductive member is developed with toner particles to form a visible image thereof. A donor member, spaced from the surface, is adapted to transport toner particles to a development zone adjacent the photoconductive member. An electrode member is positioned in the development zone between the photoconductive member and the donor member. The electrode member is electrically biased to detach toner particles from the donor member so as to form a cloud of toner particles in the development zone. Detached toner particles from the cloud of toner particles develop the latent image. Means are provided for supporting and tensioning the electrode member adjacent the donor member.

Other features of the present invention will become apparent as the following description proceeds and upon reference to the drawings, in which.

Figure 2:
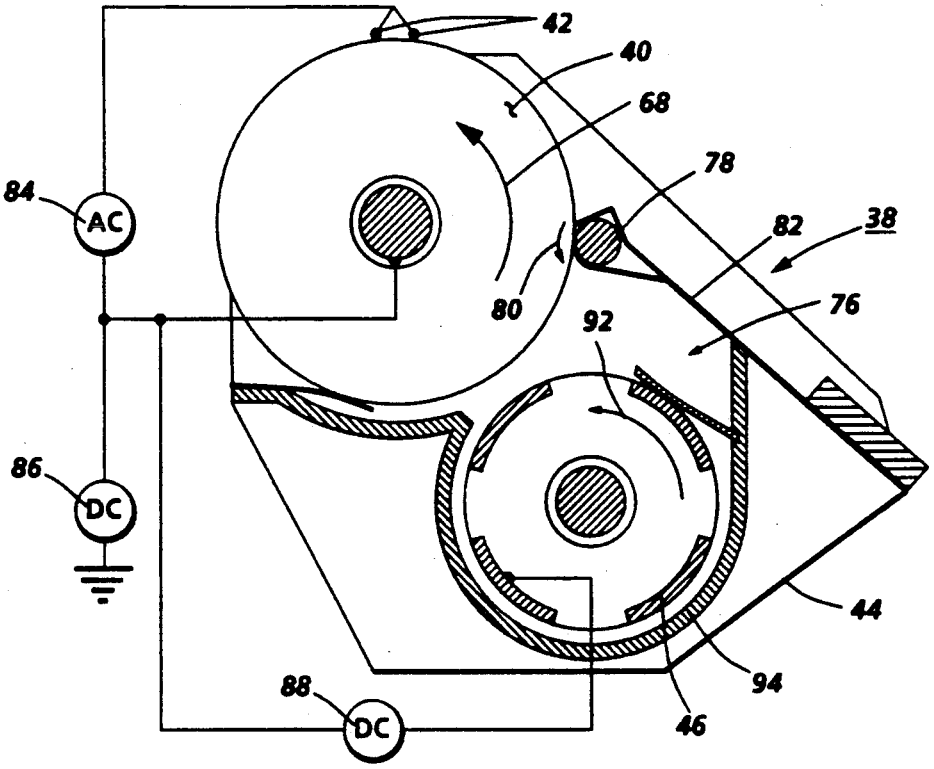
FIG. 2 is an elevational view, partially in section, showing the development apparatus used in the FIG. 1 printing machine.
Figure 4:
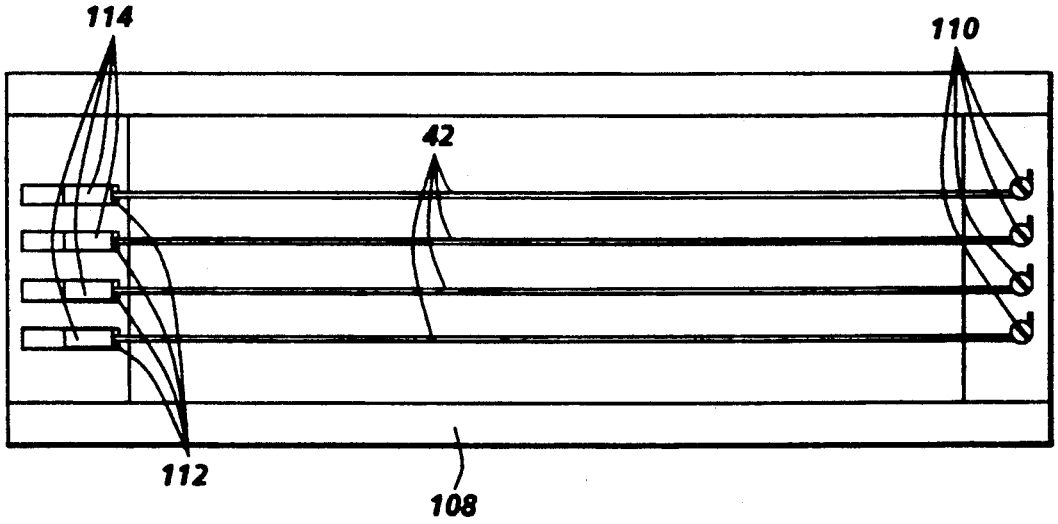

FIG. *3a* is an elevational view showing the slot in the leaf spring supporting the electrode wires; and FIG. 4 is a schematic plan view showing another embodiment of the mounting arrangement for the electrode wires of the FIG. 2 development apparatus.

While the present invention will be described in connection with a various embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
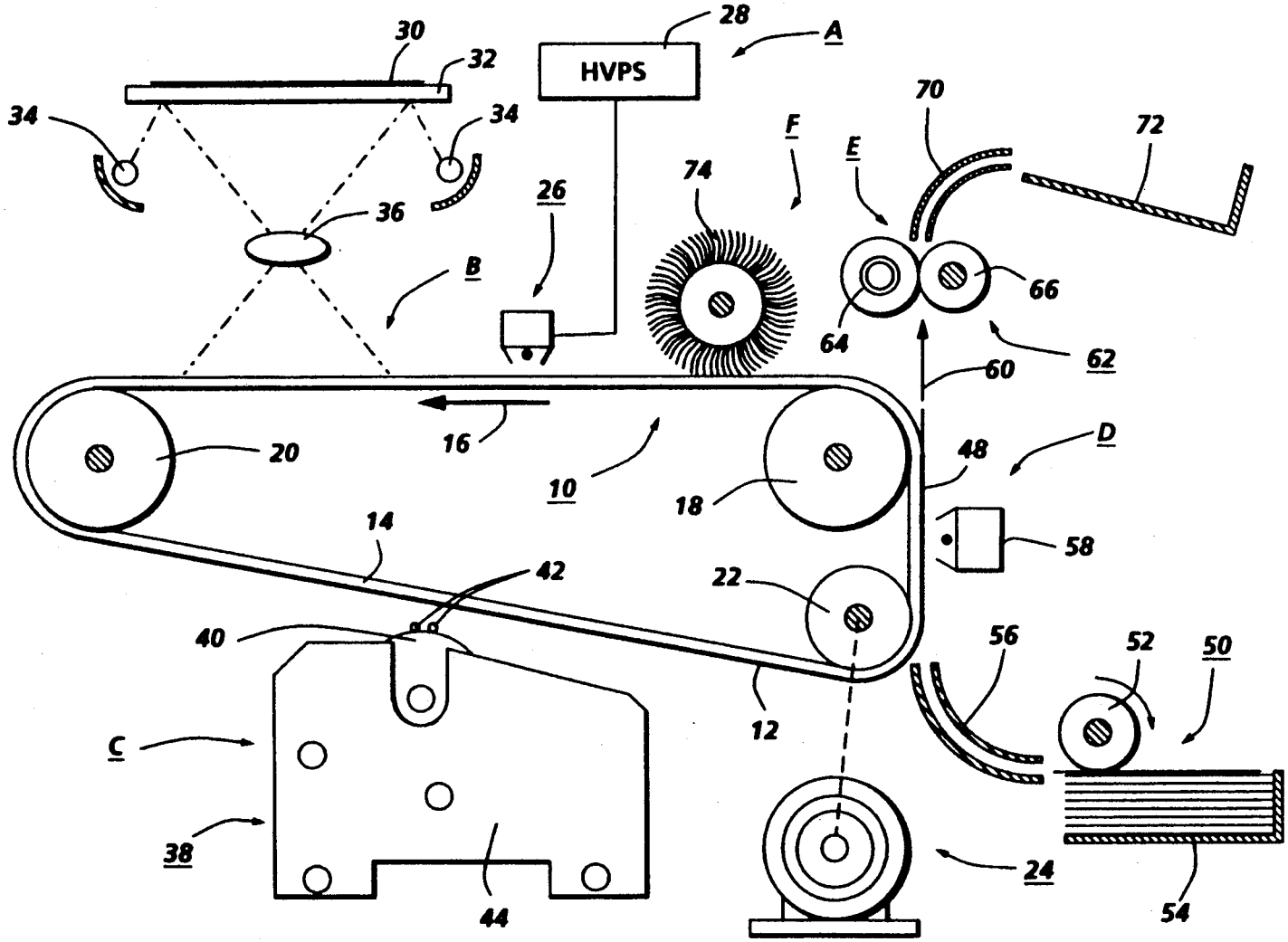
FIG. 1 is a schematic elevational view of an illustrative electrophotograhic printing machine incorporating a development apparatus having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. One skilled in the art will appreciate that any suitable photoconductive belt may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numberal 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roller 40 and electrode wires 42. A mounting arrangement supports and tensions the electrode wires adjacent donor roller 40. One embodiment of the mounting arrangment will be described hereinafter with reference to FIG. 3. Another embodiment of the mounting arrangement for the electrode wires will be discussed with reference to FIG. 4. Electrode wires 42 are electrically biased relative to donor roll 40 to detach toner therefrom so as to form a toner powder cloud in the gap between the donor roller and the photoconductive surface. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a single component developer material of toner particles. A toner mover disposed interiorly of the chamber of housing 44 conveys the toner from one end of developer housing 44 to the other end thereof. As the toner traverses the developer housing, toner is attracted from the toner mover to the donor roller. The toner mover is electrically biased relative to the donor roller so that the toner particles are attracted from the toner mover to the donor roller. Developer unit 38 will be discussed hereinafter, in greater detail, with reference to FIGS. 2 and 3.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Referring now to FIG. 2, there is shown developer unit 38 in greater detail. As shown thereat, developer unit 38 includes a housing 44 defining a chamber 76 for storing a supply of developer material therein. Donor roller 40, electrode wires 42 and toner mover 46 are mounted in chamber 76 of housing 44. The developer housing can be oriented so that the donor roller moves in either the 'with' or 'against' direction relative to the direction of motion of belt 10. In FIG. 2, donor roller 40 rotates in the direction of arrow 68. Similarly, the toner mover 46 can be rotated in either the 'with' or 'against' direction relative to the direction of motion of belt 10. In FIG. 2, toner mover 46 is shown rotating in the direction of arrow 92. A charging rod 78 is resiliently urged into engagement with donor roller 40. Charging rod 78 rotates in the direction of arrow 80. A DC voltage source electrical biases the charging rod relative to the donor roll. A leaf spring 82 supports charging rod 78. The leaf spring 82 is mounted in chamber 76 of housing 44 with the free end rotatably supporting charging rod 78. One skilled in the art will appreciate that any suitable spring may be used to support charging rod 78 and to resiliently urge it into contact with donor roller 40 Leaf spring 82 is preferably made from sheet steel. Charging rod 78 charges the toner particles adhering to donor roller 40 and regulates the thickness of the layer of toner particles on donor roller 40. Preferably, charging rod 78 is made from aluminum having a nickel coating of about 0.013 mm. Donor roller 40 is preferably made from aluminum having a polytetrafluoroethylene based resin of about 0.05 mm coated thereon. Teflon-S, a trademark of the DuPont Corporation is one such suitable resin. This coating acts to assist in charging the toner particles adhering to the surface thereof.

Figure 3:
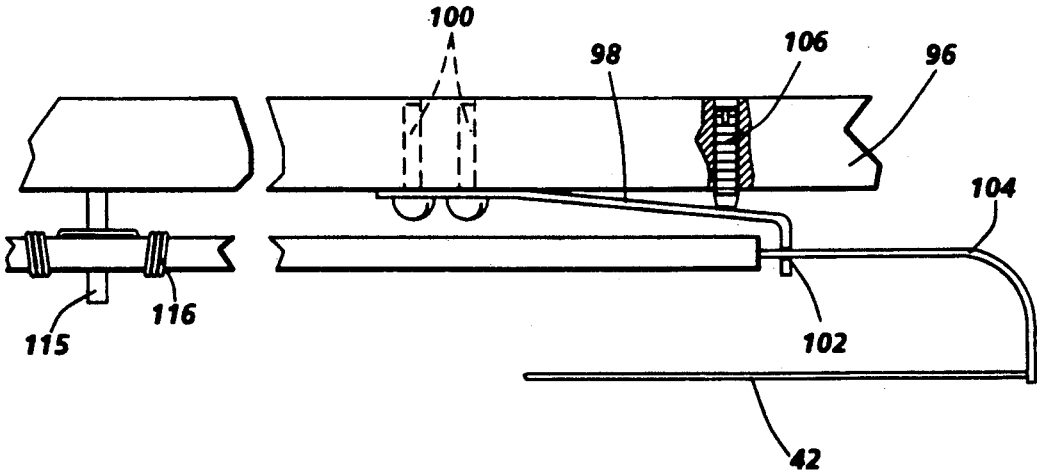
FIG. 3 is a schematic plan view showing one embodiment of the mounting arrangement for the electrode wires of the FIG. 2 development apparatus.

Development system 38 also has electrode wires 42 which are disposed in the space between the belt 10 and donor roller 40. A pair of electrode wires are shown extending in a direction substantially parallel to the longitudinal axis of the donor roller. The electrode wires are made from of one or more thin (i.e. 50 to 100$\mu$ in diameter) metal, e.g. tungsten, wires which are self-spaced from the donor roller by the thickness of the toner on the donor roller. The wires are mounted under tension. FIG. 3 discloses one embodiment for mounting the wires and FIG. 4 another embodiment.

With continued reference to FIG. 2, an alternating electrical bias is applied to the electrode wires by an AC voltage source 84. The applied AC establishes an alternating electrostatic field between the wires and the donor roller which is effective in detaching toner from the surface of the donor roller and forming a toner cloud about the wires, the height of the cloud being such as not to be substantially in contact with the belt 10. The magnitude of the AC voltage is relatively low and is in the order of 200 to 600 volts peak at a frequency ranging from about 3 kHz to about 20 kHz. A DC bias supply 86 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. The use of a dielectric coating on the donor roller helps to prevent shorting of the applied AC voltage. A DC bias supply 88 which applies approximately 500 to 1000 volts to toner mover 46 establishes an electrostatic field between toner mover 46 and donor roller 40 so that an electrostatic field is established between the donor roller and the toner mover which causes toner particles to be attracted from the toner mover to the donor roller. Toner mover 46 fluidizes the toner particles. The fluidized toner particles seek their own level under the influence of the gravity. Inasmuch as new toner particles are being discharged from a container, located at one end of housing 44, into one end of the chamber 78, the force exerted on the fluidized toner particles by the new toner particles being added at that end moves the fluidized toner particles from that end of housing 44 to the other end thereof. Toner mover 46 is an elongated member located in chamber 78 closely adjacent to an arcuate portion 94 of housing 44. Arcuate portion 94 is closely adjacent to elongated member 46 and wraps about a portion thereof. There is a relatively small gap or space between arcuate portion 94 and a portion of elongated member 46. New toner particles are discharged into one end of chamber 78 from a container. The elongated member is shorter than the donor roll to decrease toner loading on the donor roll at the ends thereof. This alleviates toner head pressure on the end seals. For a design using end feeding of toner, only the non-feed end has the elongated member shorter than the donor roll. The donor roll has detone pads in rubbing contact with the surface thereof to decrease or eliminate the toner loading on the donor roll at the ends thereof. As elongated member 46 rotates in the direction of arrow 92, toner particles are fluidized. A motor (not shown) rotates elongated member 46 at an angular velocity ranging from about 200 to about 600 revolutions per minute with the preferred set point being about 400 revolutions per minute. The force exerted on the fluidized toner particles by the new particles being discharged into chamber 76 advances the fluidized toner particles from the end of the chamber in which the new toner particles have been discharged to the other end thereof. The fluidized toner particles being moved are attracted to donor roller 40. Elongated member 46 is made from an electrically conductive material, such as aluminum. Voltage source 88 is electrically connected to elongated member 46. Elongated member 46 is spaced from donor roller 40 to define a gap therebetween. This gap is preferably about 1.0 mm. Donor roller 40 rotates in the direction of arrow 68 to move the toner particles attracted thereto into contact with the electrostatic latent image recorded on photoconductive surface 12 of belt 10. As donor roller 40 rotates in the direction of arrow 68, charging rod 78 is resiliently urged into contact with donor roller 40. Charging rod 78 is maintained in contact with donor roller 74 at a nominal nip force ranging from about 25 grams per centimeter to about 100 grams per centimeter. The toner particle layer adhering to donor roller 74 is charged to a maximum of 40 microcoulombs/gram with the toner mass adhering thereto ranging from about 0.1 milligrams/centimeter$^2$ to about 2 milligrams/centimeter$^2$ of roll surface. The fluidized toner particles are attracted from elongated member 46 to donor roller 40. Donor roller 40 transports these toner particles in the direction of arrow 68. The toner particles adhering to donor roller 40 have a net charge due to electrostatic selection from the supply of elongated member 46, and are further charged by charging rod 78 prior to advancing into contact with the electrostatic latent image recorded on photoconductive surface 12. These toner particles are attracted to the electrostatic latent image to form a toner powder image on photoconductive surface 12 of belt 10.

As shown in FIG. 2, elongated member 46 includes a hollow rod or tube having four equally spaced rows of apertures or holes therein. Each row of holes is spaced about the periphery of rod by about 90° . Each hole in each row is spaced from the next adjacent hole. The holes are equally spaced from one another. In this way, as the tube rotates, the toner particles travel through the center of the tube and out through the various holes so as to be fluidized. The fluidized toner particles are advanced from one end of the chamber of the developer housing to the other end thereof by the back pressure exerted by the head of fresh or new toner particles being discharged into the chamber from the toner storage container. Alternatively, elongated member 46 may be a rod having a cylindrical member mounted thereon. The cylindrical member has a plurality of spaced saw tooth shaped paddles extending outwardly therefrom. As elongated member 46 rotates, the paddles agitate and fluidize the toner particles. The toner particles fly off the tips of the saw tooth shaped paddles so as to be fluidized. The pressure or force exerted on the fluidized toner particles by the new toner particles being discharged from the toner container moves the fluidized toner particles from one end of the chamber 76 of housing 44 to the other end thereof.

Figure 3A:
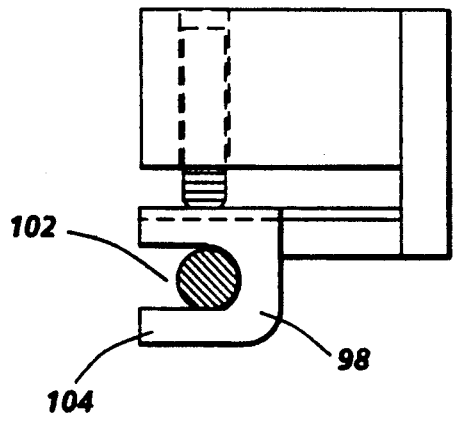

Referring now to FIGS. 3 and 3*a*, there is shown one embodiment of the mounting arrangement for supporting and tensioning the electrode wires. A tie bar 96 is mounted on housing 44 and extends in a direction parallel to the longitudinal axis of the donor roller. A leaf spring 98 is secured on either end of the tie bar. Each leaf spring has one end thereof attached fixedly to the tie bar by screws 100. The other end of each leaf spring has a slot 102 therein. A bow frame 104 is mounted in the slots of the leaf springs. Bow frame 104 is further constrained near its center by pin 115 and spring 116. Spring 116 is a torsion spring which presses the bow downward against pin 115, allowing it to rock about the top of the pin. The spring further applies a torque to the bow frame causing the bow frame to pivot pressing wires 42 against donor roll 40. This enables bow frame 104 to rotate and translate vertically while being restrained from horizontal movement by slot 102 in leaf spring 98. Electrode wires 42 are secured, at opposed ends thereof to the respective opposed ends of bow frame 104 by, for example, being spot welded or adhesively secured thereto. The degree of bow induced in frame 104 during attachment of the wires 42 determines the tension of wires 42. A plurality of wires may be supported by one frame, two are shown. The horizontal position of the spring can be adjusted by screw 106 in threaded engagement with tie bar 96. One end of screw engages spring 98. Rotation of screw 106 moves spring 98 toward or away from tie bar 96 and, in turn, adjusts the horizontal position of bow 104 with electrode wires 42 secured thereto. It is thus clear that the mounting arrangement depicted in FIG. 3 supports the electrode wires and maintains them under tension while enabling horizontal adjustments to position the electrode wires relative to the donor roll.

Turning now to FIG. 4, there is shown another embodiment of a mounting arrangement for electrode wires 42. As depicted thereat, electrode wires 42 are mounted in a rigid, substantially rectangular frame 108. Ends 110 of wires 42 are fixedly attached to one side of frame 108, e.g. by screws. Ends 112 of wires 42 are attached to springs 114. Each spring may be adjusted independently to adjust the tension of each wire independently. Alternately, if the inherent elasticity of the wires is sufficient to provide for stable tensioning, the wires may be fixedly attached at both ends. By providing an independent tensioning mechanism for each wire, the wire's correct tension is maintained independent of wire stretch or initial setup variations. Thus, frame 108 supports, holds and tensions wires 42. The frame may also provide positioning relative to the donor roller by the mounting position on the housing. A wire module mounting of this type requires minimal special handling and may be customer replaceable.

One skilled in the art will appreciate that the wire tensioning and mounting arrangement described herein may be used with other systems used to load toner on the donor roll and is not limited to the specific toner loading system described herein.

In recapitulation, it is evident that the development apparatus of the present invention includes electrode wires positioned closely adjacent the exterior surface of a donor roller and in the gap defining the development zone between the donor roller and the photoconductive belt. The electrode wires are supported in tension and may be adjusted to optimize their location relative to the donor roller. A toner mover fluidizes the toner particles in the chamber of the developer housing. Toner particles being added to the chamber at one end thereof exerts a pressure on the fluidized toner particles to move the toner particles from one end of the developer housing chamber to the other end thereof. The toner mover and the donor roller are electrically biased relative to one another so that as toner particles move from one end of the developer housing to the other end, they are attracted to the donor roller. A rotating charging rod resiliently urged into contact with the donor roller charges the toner particles and regulates the quantity of toner particles on the donor roller. An AC voltage is applied to the electrode wires to detach toner particles from the donor roller so that a toner powder cloud is formed in the development zone. Detached toner particles from the toner powder cloud are attracted to the latent image recorded on the photoconductive belt to develop the latent image.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for developing with marking particles a latent image recorded on a surface, including:

a donor member spaced from the surface and adapted to transport marking particles to a development zone adjacent the surface;

a plurality of electrode wires positioned in the development zone between the surface and said donor member, said plurality of electrode wires being electrically biased to detach marking particles from said donor member so as to form a cloud of marking particles in the development zone with detached marking particles from the cloud of marking particles developing the latent image; and means for supporting and tensioning said plurality of wires adjacent said donor member, said supporting and tensioning means comprising a frame, means for fixedly securing a first end of said plurality of wires to said frame and means for resiliently securing a second end of said plurality of wires to said frame to maintain said plurality of wires at a preselected tension, said resilient securing means being adapted to tension each of said plurality of wires independently.

2. An apparatus for developing with marking particles a latent image recorded on a surface, including:

a donor member spaced from the surface and adapted to transport marking particles to a development zone adjacent the surface;

a plurality of wires positioned in the development zone between the surface and said donor member, said plurality of wires being electrically biased to detach marking particles from said donor member so as to form a cloud of marking particles in the development zone with detached marking particles from the cloud of marking particles developing the latent image; and means for supporting and tensioning said plurality of wires adjacent said donor member, said supporting and tensioning means includes a bow shaped frame for fixedly securing opposed ends of said plurality of wires at a preselected tension, and means for holding said frame permitting rotational movement and translational movement of said frame in a first plane toward or away from said donor member while limiting translational movement of said frame in a second plane substantially perpendicular to the first plane.

3. An apparatus according to claim 2, wherein said holding means includes:

a stationary bar; and a leaf spring having a first end thereof fixedly mounted on said bar with a second end thereof having a slot for holding said frame, thereby permitting rotational movement and translational movement of said frame in the first plane toward or away from said donor member while limiting translational movement of said frame in the second plane substantially perpendicular to the first plane; and means for moving the second end of said spring toward or away from said bar to adjust the plurality of wires secured to said frame.

4. An apparatus according to claim 3 further including:

a housing defining a chamber for storing a supply of marking particles;

means, disposed in the chamber of said housing, for fluidizing the marking particles; and means for applying an electrical bias between said fluidizing means and said donor member so as to attract fluidized marking particles to said donor member.

5. An apparatus according to claim 4, further including means for charging the marking particles being advanced into contact with the latent image by said donor member.

6. An apparatus according to claim 5, wherein said charging means meters a quantity of marking particles being advanced by a donor member to the latent image.

7. An apparatus according to claim 6, wherein said donor member includes a roller.

8. An apparatus according to claim 7, wherein said charging means includes:

a rotating rod; and means for resiliently urging said rod closely adjacent to said donor roller.

9. An apparatus according to claim 8, wherein said fluidizing means includes a rotatably mounted elongated member disposed interiorly of the chamber of said housing in a region adjacent said donor roller.

10. An apparatus according to claim 9, wherein said elongated member includes a hollow rod having a plurality of rows with each row having a plurality of apertures therein.

11. An apparatus according to claim 10, wherein said electrode member includes means for electrically biasing said electrode wires.

12. An apparatus according to claim 11, wherein said donor roller includes a polytetrafluorethylene coating.

13. An apparatus according to claim 1, wherein said supporting and tensioning means is operator removable from the developing apparatus.

14. An improved electrophotographic printing machine of "the" a type in which an electrostatic latent image recorded on a photoconductive member is developed with toner particles to form a visible image thereof, wherein the improved printing machine includes:

a donor member spaced from the photoconductive member and adapted to transport toner particles to a development zone adjacent the photoconductive member;

a plurality of electrode wires positioned in the development zone between the photoconductive member and said donor member, said plurality of wires being electrically biased to detach toner particles from said donor member so as to form a cloud of toner particles in the development zone with detached toner particles from the cloud of toner particles developing the latent image; and means for supporting and tensioning said plurality of wires adjacent said member, said supporting and tensioning means comprises a frame, means for fixedly securing a first end of said plurality of wires to said frame, and means for resiliently securing a second end of said plurality of wires to said frame to maintain said plurality of wires at a preselected tension, said resilient securing means being adapted to tension each of said plurality of wires independently.

15. An improved electrophotographic printing machine of the type in which an electrostatic latent image recorded on a photoconductive member is developed with toner particles to form a visible image thereof, wherein the improved printing machine includes:

a donor member spaced from the photoconductive member and adapted to transport toner particles to a development zone adjacent the photoconductive member;

a plurality of wires positioned in the development zone between the photoconductive member and said donor member, said plurality of wires being electrically biased to detach toner particles from said donor member so as to form a cloud of toner particles in the development zone with detached toner particles from the cloud of toner particles developing the latent image; and means for supporting and tensioning said plurality of wires adjacent said donor member, said supporting and tensioning means includes a bow shaped frame for fixedly securing opposed ends of said plurality of wires at a preselected tension, and means for holding said frame permitting rotatonal movement and translational movement of said frame in a first plane toward or away from said donor member while limiting translational movement of said frame in a second plane substantially perpendicular to the first plane.

16. A printing machine according to claim 15, wherein said holding means includes:

a stationary bar;

a leaf spring having a first end thereof fixedly mounted on said bar with a second end thereof having a slot for holding said frame, thereby permitting rotational movement and translational movement of said frame in the first plane toward or away from said donor member while limiting translational movement of said frame in the second plane substantially perpendicular to the first plane; and means for moving the second end of said spring toward or away from said bar to adjust the plurality of wires secured to said frame.

17. A printing machine according to claim 16 further including:

a housing defining a chamber storing a supply of toner particles therein;

means, disposed in the chamber of said housing, for fluidizing the toner particles; and means for applying an electrical bias between said fluidizing means and said donor member so as to attract fluidized toner particles to said donor member.

18. A printing machine according to claim 17, further including means for charging the toner particles being advanced into contact with the latent image by said donor member.

19. A printing machine according to claim 18, wherein said charging means meters a quantity of toner particles being advanced by a donor member to the latent image.

20. A printing machine according to claim 19, wherein said donor member includes a roller.

21. A printing machine according to claim 20, wherein said charging means includes:

a rotating rod; and means for resiliently urging said rod closely adjacent to said donor roller.

22. A printing machine according to claim 21, wherein said fluidizing means includes a rotatably mounted elongated member disposed interiorly of the chamber of said housing adjacent said donor roller.

23. A printing machine according to claim 22, wherein said elongated member includes a hollow rod having a plurality of rows with each row having a plurality of apertures therein.

24. A printing machine according to claim 23, wherein said electrode member includes means for electrically biasing said electrode wires.

25. A printing machine according to claim 24, wherein said donor roller includes a polytetrafluorethylene coating.

* * * * *